US006053040A

United States Patent [19]

Callender et al.

[11] Patent Number: 6,053,040

[45] Date of Patent: Apr. 25, 2000

[54] SYSTEM FOR THE DETECTION AND CONTROL OF PAPER MACHINE PROFILES

[76] Inventors: Anne Callender, 5321 Stiles La., Pace, Fla. 32571; Leonard Fiore, 11610 45th St. Northeast, Foley, Minn. 56329; Robert Rudt, 17 Butternut Ct., Highland Mills, N.Y. 10930

[21] Appl. No.: 09/127,852

[22] Filed: Aug. 3, 1998

[51] Int. Cl.[7] ..... G01L 5/04

[52] U.S. Cl. ..... 73/159

[58] Field of Search ..... 73/159, 73

[56] References Cited

U.S. PATENT DOCUMENTS

| | | | |
|---|---|---|---|
| 3,524,988 | 8/1970 | Gaither, IV | 73/159 |
| 4,324,136 | 4/1982 | Ashford | 73/159 |
| 4,502,793 | 3/1985 | Smith et al. | 73/159 X |
| 4,788,853 | 12/1988 | Bell . | |
| 4,789,820 | 12/1988 | Parrent, Jr. et al. . | |
| 4,903,528 | 2/1990 | Balakrishnan et al. . | |
| 4,939,929 | 7/1990 | Ostman . | |
| 4,953,400 | 9/1990 | Bossuyt | 73/159 |
| 5,049,216 | 9/1991 | Shead et al. . | |
| 5,327,770 | 7/1994 | Hindle | 73/159 X |
| 5,333,493 | 8/1994 | Cutmore . | |
| 5,623,850 | 4/1997 | Szczepaniak et al. | 73/159 |
| 5,636,126 | 6/1997 | Heaven et al. . | |
| 5,649,448 | 7/1997 | Koskimies et al. . | |
| 5,717,456 | 2/1998 | Rudt et al. . | |

*Primary Examiner*—Benjamin R. Fuller
*Assistant Examiner*—Jewel Thompson

[57] ABSTRACT

A system is provided for the detection and control of a paper machine profile. The system is adapted to observe a physical characteristic of a moving, continuous paper web. For example, the system can observe a change in moisture content in the web, as represented by a "wet line". In response to observations of the physical characteristic, the system can also be adapted to adjust process controls and/or the physical composition of the web in an attempt to achieve a desired profile of the physical characteristic.

20 Claims, 1 Drawing Sheet

SYSTEM FOR THE DETECTION AND CONTROL OF PAPER MACHINE PROFILES

BACKGROUND OF THE INVENTION

1. Field of the Invention

This invention relates to the detection and control of paper machine profiles and, more particularly, to the detection and control of a physical characteristic, such as moisture content, of a paper machine profile.

2. Description of the Prior Art

In the prior art, there exists systems for determining a physical characteristic, such as moisture content, of a moving paper web. The systems rely on actual measurement of the physical characteristic through data obtained by microwave sensors, radiation sensors, and the like. The sensors are either fixed-point or adapted to scan a profile of the web in the cross direction. (Cross direction is defined as the direction normal to the direction of movement of the web. In contrast, machine direction is defined as a direction parallel to the direction of movement of the web.)

The prior art, however, suffers from several drawbacks. First, often relatively complex iterative calculations need to be performed to determine the physical characteristic of the web based on readings obtained by prior art sensors. Second, the use of prior art radioactive devices is not desirable due to the potential harm which may be caused by a malfunction or failure of the radioactive device. Third, the prior art sensors have limited mobility, even the scanning sensors. Scanning sensors are typically fixed to move along a predetermined path, and the path is often chosen to compensate for variations of characteristics in the machine direction of the web, due to the continuous movement of the web during a scanning procedure. However, the path of such scanners is not typically movable relative to the web along the machine direction.

It is, thus, an object of the subject invention to provide a system for readily discerning a physical characteristic, such as moisture, of a moving web.

It is also an object of the subject invention to adjust process controls of a paper making machine in response to data obtained relating to a physical characteristic of the web.

It is yet another object of the subject invention to provide a system capable of adjusting the physical makeup of a paper web in response to data obtained relating to a physical characteristic of the web.

SUMMARY OF THE INVENTION

The above-stated objects are met by a system including an observing means, such as one or more digital or analogy cameras and computer having a capture board for analyzing data such as images obtained by the camera. The system is for detecting a physical characteristic of a moving web. For a full understanding of the system, the system is described below with respect to detecting moisture content of the web. The system, however, is not limited to this application.

In the first step of a paper making process, pulp is deposited onto a forming fabric to create a continuous web. The forming fabric is porous to allow some drainage of water from the web therethrough. A vacuum may be applied at several locations below the forming fabric to increase the rate of drainage of water from the web. In viewing the web as it moves along the forming fabric, typically, a "wet line" is visible. The wet line extends in the cross direction and is defined by the web due to a noticeable change in the sheen of the web, resulting from a certain amount of moisture having been extracted from the web. Ideally, the wet line is a straight line in the cross direction and is fixed to a single location relative to the machine direction. In actual practice, the wet line is typically jagged, with variations in both the cross and machine directions. By achieving an ideal wet line, there is an indication that the web is continuously draining at an even rate across the entire width in the cross direction and at the same location in the machine direction. The key to making a good sheet of paper efficiently is to make all the physical characteristics of the sheet as uniform as possible and to dry the sheet as much as possible before passing it along to the press section, which is the next stage of the paper making process. The presence of an ideal wet line is an indicator of uniform drainage or sheet dryness.

As opposed to prior art methods of measuring and determining moisture in a paper web, the system of the subject invention relies on observation of the wet line. The digital camera may be rigidly mounted to a fixed point to observe the wet line, wherein the field of view of the camera is a rectangular band dimensioned to extend across the entire width of the web and along a portion of the web in the machine direction. Alternatively, the camera may be mounted to scan a profile of the web in the cross direction. Advantageously, the camera can be used to observe a plurality of locations on the web along the machine direction, by either simply re-directing the lens or physically moving the entire camera. The use of a digital camera allows for a digital image of the profile to be obtained in a very short time frame, on the order of 10 milliseconds. In contrast, certain scanning prior art devices require 30 seconds to perform one scan. Fluorescent additives might also be added to the web in order to enhance the appearance of the observed profiles under ultraviolet light or with the use of special photographic filters mounted to the camera.

The digital image obtained by the camera is transmitted to the digital computer for analysis, wherein the digital computer discerns the actual wet line of the web. The computer preferably has a pre-programmed location of an ideal wet line, which is compared by the computer to actual obtained data. Alternatively, the computer may simply display the obtained data for visual analysis by an operator. The use of a digitally-encoded image allows for near real-time analysis and/or display by the computer.

The digital computer may be connected to certain process controls so that, based on the differences between the observed wet line and a pre-programmed wet line, the computer may automatically adjust process characteristics to minimize such differences. For example, foil angles, vacuum levels, impingement angle, jet/wire ratio, etc. may be adjusted to favorably affect the wet line. Furthermore, the obtained information may be transmitted to the main control system for the entire paper making machine for further process-control refinements and evaluation.

Additionally, the digital computer may be connected to controls affecting the physical characteristics of the pulp. For example, the consistency of the pulp, which is the ratio of the amount of water to fiber originally input into the system, may be adjusted in attempting to achieve the ideal wet line.

The system of the subject invention can be used in other applications. For example, the system can be employed in the dryer section of a paper making machine to observe a "dry line" in the web. The dry line extends in the cross direction and, similar to the wet line, is defined by the web resulting from a certain amount of moisture having been extracted from the web. With the inventive system disclosed herein, observation and analysis of the dry line can be used to control steam, mist showers, etc. to adjust the drying rate in an attempt to idealize the dry line. Also, the system of the subject invention can be used to observe physical characteristics of the web other than moisture. In situations where a wet line is not visible, infrared light, rather than conventional visible light, may be employed to observe isotherms formed in the web, thus determining the thermal profile thereof. The obtained thermal data may be compared to predetermined desired data and, again, various machine controls may be adjusted in an attempt to minimize differences therebetween.

Finally, the system can be employed with paper making machines adapted for the manufacture of various grades of paper. With the shift of production from one grade to another in the machine, the system of the subject invention, having pre-programmed therein information relating to each of the desired grades, can be used to rapidly adjust the controls of the paper-making process to optimize the manufacture of each respective grade of paper.

These and other embodiments of the invention will be better understood through a study of the following detailed description and accompanying drawings.

DETAILED DESCRIPTION OF THE PREFERRED EMBODIMENTS

Figure 1:
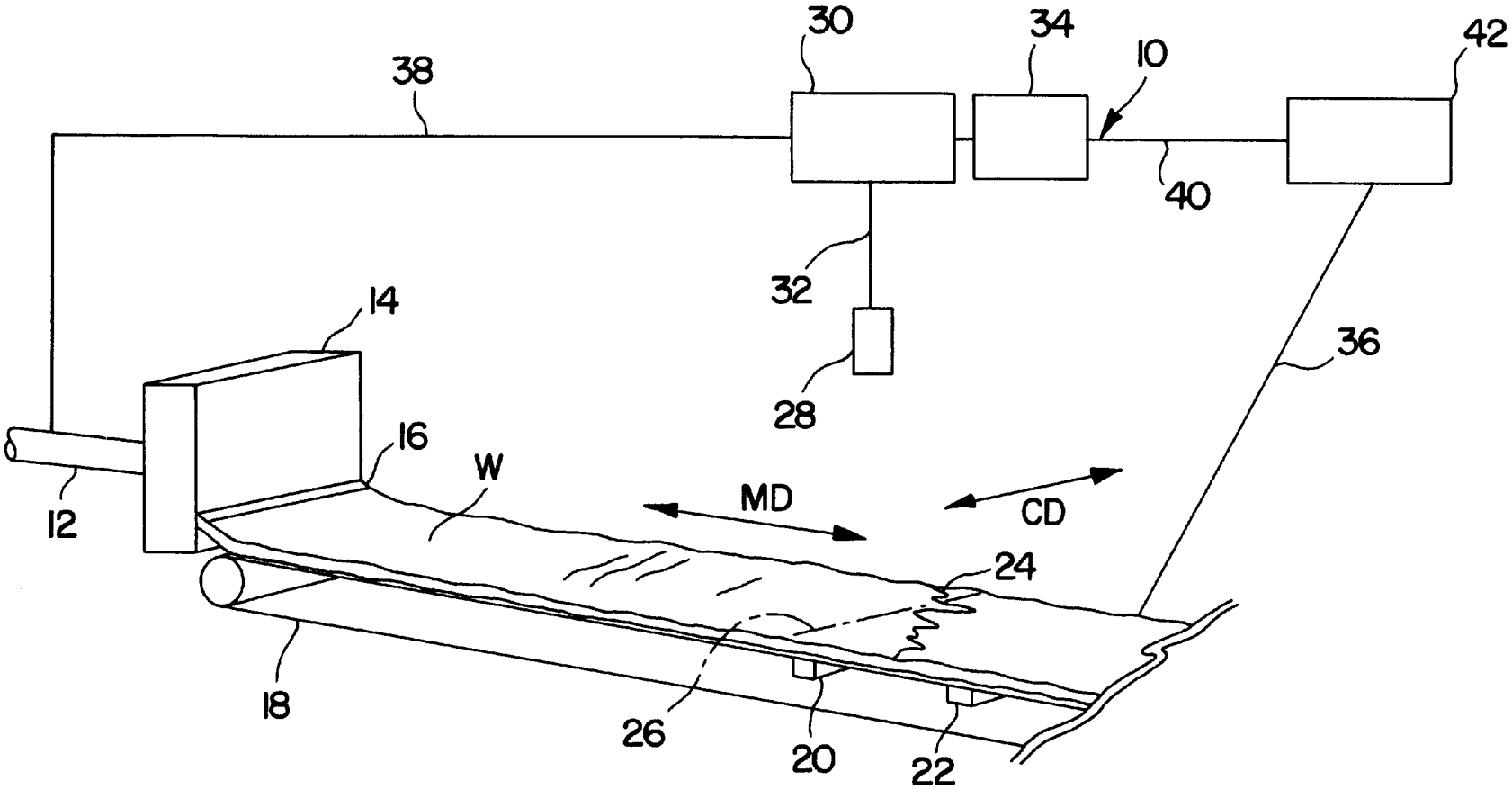
FIG. 1 is a schematic depicting the system of the subject invention.

Referring to FIG. 1, a system 10 is shown therein for detecting and controlling a physical characteristic of a paper web W, such as moisture or variations in web characteristics which may be visually discerned. In FIG. 1, the system is shown in conjunction with the forming section, which is the first step in a paper making process. It is to be understood that the depiction of FIG. 1, and the accompanying description, are intended to disclose an exemplary application of the system 10, and the system 10 is not limited to only this application. Using the teaching disclosed herein, the system 10 may be used in conjunction with other section used in the paper making process, such as in the dryer section, and for detecting and controlling other physical characteristics of the web W, such as temperature distribution.

The web W is formed from pulp. The pulp is supplied through an inlet pipe 12, deposited into a head box 14, and extruded through a slot 16 formed in the head box 14 to continuously shape the web W. The web W is disposed onto a moving, porous forming fabric 18. The porosity of the forming fabric 18 allows for drainage of water from the web W. To further enhance the drainage of water from the web W, vacuums 20, 22 may be disposed below the forming fabric 18. It can be appreciated that the rate of drainage of water from the web W is affected by many factors including, but not limited to, the rate of travel of the forming fabric 18 porosity of forming fabric 18, the strength of the vacuum applied by the vacuums 20, 22, and the initial consistency of the pulp used to form the web W.

Due to the removal of water from the web W, a wet line 24 is defined by a noticeable change in the shininess or sheen of the web W. As shown in FIG. 1, the wet line 24 is typically jagged, having variations both in the cross and machine directions, and moves to and fro in the machine direction. Ideally, the wet line 24 should be a stationary, straight line which extends in the cross direction, perpendicular to the machine direction, as shown by the dash-dot-dash line 26.

The system 10 comprises observing means, for monitoring one or more characteristics of the web and transmitting a signal of the monitored characteristics of the web. Observing means 28 may vary widely and includes by way of illustration digital and analog cameras, infrared detectors, reflective detectors and the like. In the preferred embodiments of the invention, observing means 28 monitors by observation and collects and transmits an image of a portion of the Web W. Preferably, monitoring means 28 is a digital camera. Preferably, the observing means 28 is a digital camera. Alternatively, an analog video recorder may be utilized with a separate digital converter. The observing means 28 is positioned with a portion of the web W being within the field of view thereof. Preferably, the observing means 28 views a rectangular portion of the web W, which extends across the full width of the web W in the cross direction and a portion of the web W in the machine direction. As such, the observing means 28 allows for simultaneous collection of data relating to cross directional and machine directional profiles of the web W. The observing means 28 is located to observe the change in the monitored physical characteristic of the web W. For example, as shown in FIG. 1, the field of view of the observing means 28 must be established to include the anticipated location of the wet line 24.

The system 10 also includes a digital computer 30 for analyzing and/or displaying the digital image collected by the observing means 28 and transmitted via line 32. The computer 30 is preferably pre-programmed to include data relating to ideal values of the monitored physical characteristic of the web W, such as the ideal wet line 26. A comparator 34 is provided for comparing the predetermined ideal values and actual data obtained by the observing means 28. The function of the comparator 34 may be performed by the computer 30, or the comparator 34 may be a second digital computer.

The system 10 determines actual values of the monitored physical characteristic of the web W, not through measuring the characteristic, but rather through discerning the characteristic in data obtained by the observing means 28. In the example shown in FIG. 1, the computer 30 is adapted to compare the levels of sheen observed by the observing means 28 and, thus, determine the shape and location of the actual wet line 24. The data relating to the actual physical characteristic of the web W is compared by the comparator 34 to the ideal predetermined values of the physical characteristic. As shown in the FIG. 1, a closed loop control system may be formed, wherein comparator 34 is linked through connector 40 to the main control system 42 for the entire paper making machine which adjust machine process controls via connection 36 and/or other connections not depicted to control machine operation for adjustment of the physical characteristic. For example, the computer 30 may accordingly adjust the level of vacuum induced by the vacuums 20 and 22 in an attempt to idealize the wet line 24. Such adjustment of the level of vacuum may cause the wet line 24 to move in the machine direction, as well as change shape relative to the cross direction. Additionally, the closed control loop system may be configured to adjust the physical composition of the pulp used to form the web W, such as through manipulation of the consistency of the Web W. An alternative method for controlling the uniformity of the Web W in the cross machine direction is though control or adjustment of slice screws or jacks on the head box. Appropriate interfaces to properly adjust the process and/or physical composition controls may be integrally formed with the computer 30 or be free-standing.

The information generated by the computer 30 may be valuable in evaluating the overall paper making process. Thus, a connection, through connector 40, to the main control system 42 for the entire paper making machine process may be desired. In this manner, data may be archived and evaluated over time.

As is readily apparent, numerous modifications and changes may readily occur to those skilled in the art and, hence, it is not desired to limit the invention to the exact construction and operation shown and described, and, accordingly, all suitable modification equivalents may be resorted to falling within the scope of the invention as claimed. For example, under infrared light, the system 10 may be adapted to discern isotherms formed in the web W, resulting in appropriate process and/or physical characteristic control adjustments. Additionally, the system may be employed in other sections of the paper making machine process, such as discerning the dry line in the dryer section.

What is claimed:

1. A system for monitoring a wet line of a wet continuous, moving web of paper formed by depositing wet pulp on a forming fabric of a paper making machine in a paper making process and subjecting said deposited pulp to a vacuum to increase a rate of water drainage from said deposited pulp and for controlling the paper making machine or paper making process to enhanced uniformity of drying, said system comprising:

at least one observing means for collecting an image of a portion of said web comprising the wet line of said web and transmitting a digital image of said portion of the web;

computer means for receiving said digital image and for discerning from said digital image an actual profile of said wet line of the web;

comparator means for comparing said discerned actual profile of said wet line of said web and predetermined ideal profile of said wet line; and means for modifying an operation of said machine or said process to reduce the differences between said actual profile of wet line and said ideal profile of said wet line when said differences exceed a certain amount.

2. A system as in claim 1, further comprising interface means for selectively adjusting the controls of the process for forming the paper web in response to signals from said comparator means.

3. A system as in claim 1, further comprising interface means for selectively adjusting the physical composition of the web in response to signals from said comparator means.

4. A system as in claim 3, wherein the wet line of said web is discerned by the comparison of the amount of sheen at various locations on the web including the location at or about the wet line.

5. A system as in claim 1, wherein said camera is movable relative to the web.

6. A system as in claim 1, wherein said computer means displays said digital image.

7. A system as in claim 1, wherein said camera collects and transmits a digital image of a rectangular portion of the web.

8. A method for monitoring a wet line of a wet, continuous, moving paper wet web formed by depositing wet pulp on the forming fabric of a paper making machine in a paper making process and subjecting said deposited pulp to a vacuum to increase a rate of water drainage from said deposited pulp controlling a characteristics of said said wet line said method comprising a set of;

collecting an image of a portion of said web comprising said wet line; and transmitting a digital image of said portion of said web;

determining from said digital image an actual profile of said wet line;

determining an ideal profile of said wet line;

comparing said actual profile of said wet line and an ideal values of the wet line; and modifying an operation of said paper machine and/or said process to reduce differences between said actual profile of wet line and ideal profile of the wet line if said differences exceed a certain amount.

9. A method as in claim 8, further comprising the step of adjusting the controls of the process of the manufacture of the web in response to the step of comparing said actual physical characteristic of the web and said ideal values of the physical characteristic of the web.

10. A method as in claim 8, further comprising the step of adjusting the physical composition of the web in response to the step of comparing said actual physical characteristic of the web and said ideal values of the physical characteristic of the web.

11. A method as in claim 8, wherein the physical characteristic is moisture content.

12. A method as in claim 11, wherein the moisture content of the web is discerned through the comparison of the amounts of sheen at various locations on the web.

13. A method as in claim 8, wherein said step of collecting a digital image of a portion of the web includes collecting a digital image of a rectangular portion of the web.

14. A system as in claim 1 wherein said observing means is a camera.

15. A method as in claim 8, wherein said image is collected by a camera.

16. A system as in claim 14 wherein said camera is an analog camera.

17. A system as in claim 14 wherein said camera is a digital camera.

18. A method as in claim 15 wherein said camera is an analog camera.

19. A method as in claim 15 wherein said camera is a digital camera.

20. System of claim 14 wherein said camera is mounted with respect to the web such that its field of view is a rectangular or substantially rectangular band dimensioned to extend across the entire or substantially the entire web and along a portion of the web in the machine direction.

* * * * *